United States Patent [19]

Tokita et al.

[11] Patent Number: 4,727,282

[45] **Date of Patent: * Feb. 23, 1988**

[54] COLOR CATHODE-RAY TUBE

[75] Inventors: Kiyoshi Tokita; Michio Nakamura, both of Fukaya, Japan

[73] Assignee: Tokyo Shibaura Denki Kabushiki Kaisha, Kawasaki, Japan

[ * ] Notice: The portion of the term of this patent subsequent to Jan. 13, 2004 has been disclaimed.

[21] Appl. No.: 888,214

[22] Filed: Jul. 23, 1986

Related U.S. Application Data

[62] Division of Ser. No. 588,108, Mar. 9, 1984, Pat. No. 4,636,683.

[30] Foreign Application Priority Data

Mar. 10, 1983 [JP] Japan ..... 58-38218

[51] Int. Cl.[4] ..... H01J 29/07

[52] U.S. Cl. ..... 313/403; 313/408

[58] Field of Search ..... 313/402, 403, 407, 408

[56] References Cited

U.S. PATENT DOCUMENTS 4,136,300 1/1979 Morrell ..... 313/403

4,636,683 1/1987 Tokita et al. ..... 313/403

FOREIGN PATENT DOCUMENTS 2160353 12/1985 United Kingdom .

*Primary Examiner*—Leo H. Boudreau

*Assistant Examiner*—Sandra L. O'Shea

*Attorney, Agent, or Firm*—Cushman, Darby & Cushman

[57] ABSTRACT

A color cathode-ray tube is disclosed, which has a shadow mask facing the face plate inner surface and having slit apertures formed in a predetermined arrangement. The center-to-center distance or interval Px of the slit apertures on the horizontal axis increases as a first function along the horizontal axis from the center of the shadow mask to the periphery region thereof. The center-to-center distance or interval Sx in peripheral regions of the shadow mask remotest from the horizontal axis increases as a second function different from the first function along the horizontal axis from the vertical axis to the periphery region thereof. The first and second functions representing the respective slit aperture intervals Px and Sx are given as $$Px = PO + A\left(\sum_{1}^{x} P_{x-1}\right)^{\alpha}$$

$$Sx = PV + B\left(\sum_{1}^{x} S_{x-1}\right)^{\beta}$$

where X is 1, 2, 3, . . . , and $\alpha$ and $\beta$ are $\alpha < 3$ and $\beta \leqq 6$.

6 Claims, 9 Drawing Figures

COLOR CATHODE-RAY TUBE

This is a division of application Ser. No. 588,108 filed Mar. 9, 1984 now U.S. Pat. No. 4,636,683 issued Jan. 13, 1987.

BACKGROUND OF THE INVENTION

This invention relates to a color cathode-ray tube and, more particularly, to a color cathode-ray tube incorporating a shadow mask having slit apertures.

Generally, in a color cathode-ray tube incorporating a shadow mask having slit apertures, a phosphor screen having groups of red, green and blue phosphor stripes is formed on the inner surface of the face plate. In the neck of the cathode-ray tube, in-line type electron guns are received. Three electron beams are emitted from the electron guns to pass through the slit apertures and land on the phosphor stripes while they are deflected by a deflection device provided around a funnel.

In such a color cathode-ray tube, the electron beams are deflected and the shadow mask is scanned by the electron beams, so that the electron beams impinge on and heat the shadow mask when the electron beams are not directed to the slit apertures. Generally, the amount of electron beams passing through the slit apertures is substantially less than one-third of the total emitted electron beams. The energy of the rest of the electron beams is consumed as the electron beams strike and heat the shadow mask. For this reason, the shadow mask is sometimes heated up to as high a temperature as 80° C. The shadow mask is usually made of a material mainly composed of iron which has a relative high coefficient of thermal expansion and has a thickness of 0.1 to 0.3 mm, and its pheripheral edge is reinforced by a mask frame about 1 mm in thickness and having high mechanical strength. When the shadow mask is heated by the electron beams and expanded, it is deformed into a dome-like shape, thus changing the distance between it and phosphor screen (the distance being referred to as Q value). When the Q value exceeds a predetermined value, the electron beams no longer accurately land on the corresponding phosphor stripes, that is, mislanding occurs, thus deteriorating the color purity. In order to prevent the mislanding, the mask frame is fixed by a bimetal member to the face plate inner surface, as disclosed in U.S. Pat. No. 3,803,436. When the shadow mask is heated beyond a predetermined temperature so that it is expanded, its heat is transferred to the bimetal member, causing deformation thereof such as to hold the mislanding within a permissible value. In this case, however, the heat of the shadow mask is transferred to the bimetal member through the mask frame which has high heat capacity. Therefore, it is liable that the shadow mask will undergo thermal expansion into a dome-like shape before the deformation of the bimetal occurs. In this case, temporary mislanding would occur.

Generally, the deformation or doming of the shadow mask depends on the curvature of the shadow mask.

Generally, the smaller the curvature of the shadow mask, the greater the deformation or doming of the shadow mask due to heating thereof. In other words, the greater the radius of curvature of the shadow mask, i.e., the flatter the shadow mask, the greater the deformation to cause the color purity deterioration. More simply, the color purity is more liable to be deteriorated by increasing the radius of curvature of the shadow mask and thus making it flatter. For this reason, in the conventional color cathode-ray tube, the radius of curvature of the shadow mask is made relatively small so that the shadow mask is curved relatively greatly while the face plate is also curved relatively greatly so that the phosphor screen itself is curved relatively greatly. With the color cathode-ray tube where the face plate is curved in this way, it is rather difficult to accurately monitor the image or pattern. This problem is prominent for a color cathode ray tube with a greater screen size. That is, with the radius of curvature fixed the doming is prominent with a shadow mask of larger size than with a shadow mask of a smaller size to an extent that it cannot be disregarded.

Further, if it is intended to make the inner surface of the face plate of the color cathode-ray tube flatter so that the front shape thereof has substantially a rectangular shape, the following problem arises in addition to the phenomenon of doming described above. Where the shadow mask and face plate inner surface have a relatively small radius of curvature and curved relatively greatly, the phosphor screen has a barrel-like shape as shown in FIG. 1. In this phosphor screen, phosphor stripes in end regions on the horizontal axis X—X are curved with a relatively small radius of curvature having the center of curvature in the phosphor screen. In other words, the distance between the corners of the phosphor screen along the horizontal axis X—X is smaller than the width H of the phosphor screen on the horizontal axis X—X, that is, there is a difference $\Delta H$ between them. In a color cathode-ray tube where the face plate inner surface is made flatter so that it has substantially a rectangular front shape, the difference $\Delta H$ between the dimensions H and h is certainly reduced. In this case, the phosphor stripes in the pheripheral regions of the phosphor screen remotest from the vertical axis Y—Y are curved with a relatively large radius r of curvature. However, since the front portion of the face plate has substantially rectangular shape, the phosphor screen which is curved only slightly would seem more dissatisfactory in appearance than the conventional cathode-ray tube.

SUMMARY OF THE INVENTION

An object of the invention is to provide a color cathode ray tube, which can ensure good color purity by preventing the mislanding of electron beams on the phosphor screen throughout its operation.

According to the invention, there is provided a color cathode-ray tube having a tube axis, a horizontal axis and a vertical axis, these axes being perpendicular to one another, comprising: a face plate having an inner surface; a phosphor screen formed on the inner surface of the face plate and including a plurality of groups of red, green and blue phosphor stripes, the phosphor stripes extending across the horizontal axis and being spaced apart therealong; means for emitting electron beams toward the phosphor screen, the emitting means including electron guns arranged along the horizontal axis; and a shadow mask including a curved plate portion facing the inner surface of the face plate and having a plurality of slit apertures allowing passage of electron beams therethrough, the center-to-center interval Px between adjacent slit apertures on the horizontal axis being increased as a first function along the horizontal axis from the vertical axis of the shadow mask to the periphery thereof, the center-to-center interval Sx between adjacent slit apertures in peripheral regions remotest from the horizontal axis being increased as a second function different from the first function along the horizontal axis from the vertical axis of the shadow mask to the periphery of the shadow mask.

DETAILED DESCRIPTION OF THE PREFERRED EMBODIMENT

Figure 2:
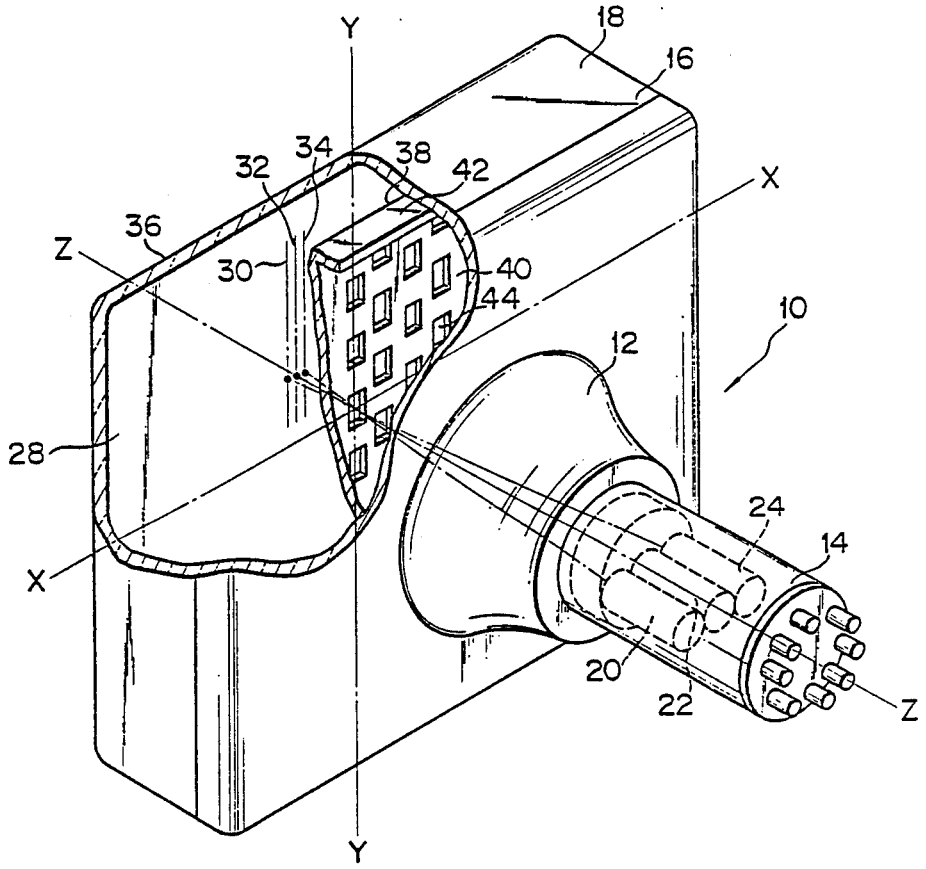
FIG. 2 is a perspective view, partly broken away, showing an embodiment of the color cathode tube according to the invention.

Referring to FIG. 2, there is shown in a color cathode-ray tube embodying this invention. The illustrated cathode-ray tube has a vacuum glass envelope 10, which has a funnel section including a neck 14 extending substantially along a tube axis Z—Z. The funnel section is hermetically sealed in a skirt 18 of a glass panel section 16 having a face plate 36 of which a front portion is formed into a substantially rectangular shape. The neck 14 receives therein in-line electron guns 20, 22, 24, which are arranged in line parallel with the horizontal axis X—X and emit electrons of primary colors, i.e., of red, blue and green. A deflection yoke device 12 for deflecting electron beams is arranged around the funnel section. A phosphor screen 28 for emitting light upon the landing of electron beams on the red, blue and green phosphor stripes 30, 32 and 34 thereon, is formed on the relatively flat inner surface of a face plate 36 of the glass panel section 16. A shadow mask 38 having a curved plate portion 40 and a skirt portion 42 is received in the glass panel section 16. The front shape of the plate portion 40 is formed into a substantially rectangular form and the plate portion 40 faces the phosphor screen 28. The plate portion 40 has a number of slit apertures 44, which are arranged along the horizontal and vertical axes X—X and Y—Y. The skirt portion 42 extends from the peripheral edge of the plate portion 40 along the tube axis and is reinforced by a mask frame (not shown). A bimetallic member (not shown) is fixed between the mask frame and the inner peripheral surface of the panel section 18. The ratio of the dimensions of the plate portion 40 of the shadow mask 38 along the horizontal and vertical axes X—X and Y—Y, is substantially set at 4:3. In such a color cathode tube, the electron beams emitted from the electron guns 20, 22 and 24 are converged and deflected by the deflection yoke device. The shadow mask 38 is scanned by the converged electron beams, and the electron beams passed through the slit apertures 44 of the shadow mask 38 land on the phosphor stripes 30, 32 and 34 to cause light emission thereof. When the distance between the shadow mask 38 and the inner surface of the face plate 36, i.e., the Q value, is maintained at a predetermined fixed value, the electron beams accurately land on the corresponding phosphor stripes 30, 32 and 34. When the shadow mask 38 is heated by the electron beams, its shape is changed into a dome-like form. When the doming occurs, the Q value is changed so that the electron beams no longer land on the corresponding phosphor stripes 30, 32 and 34 accurately, that is, mislanding results. The heating of the shadow mask will cause a deformation of the bimetallic member in such a manner as to maintain the landing tolerance within a permisible value. However, the bimetallic member 38 is not deformed as soon as the shadow mask 38 is heated, and temporary mislanding is liable to occur to deteriorate the color purity during the process of correction of the Q value.

The mislanding or doming of the color cathode-ray tube is prevented in the following way. The phosphor screen is formed such that the center-to-center distance or interval of the adjacent groups of red, blue and green phosphor stripes on the phosphor screen (hereinafter referred to as phosphor stripe interval) increases along the horizontal axis from the center of the phosphor screen to the periphery thereof. Also, the shadow mask that faces the phosphor screen is formed such that the center-to-center distance or interval of its slit apertures (hereinafter referred to as slit aperture interval) increases along the horizontal axis X—X from its center to its periphery. Further, it is formed such that its section in a horizontal plane defined by the tube axis and horizontal axis is curved with a curvature larger than that of the face plate 36. In the color cathode ray tube having the phosphor screen 28 and shadow mask 38 formed in the manner as described, the deformation of the doming of the shadow mask may be reduced. However, when the phosphor screen 28 is formed on the face plate by the shadow mask 38 described above, the arrays of phosphor stripes remotest from the vertical axis Y—Y appeared more curved than they actually are in the phosphor screen 28 of a substantially rectangular shape, because the face plate 28 is formed into a substantially rectangular shape. This appearance of the face plate is somewhat disatisfactory. By way of example, in a conventional 18-inch color cathode-ray tube, in which the radius of curvature of the face plate inner surface is approximately 711 mm and the radius of curvature of the shadow mask is approximately 640 mm in a horizontal plane defined by the tube axis and horizontal axis and approximately 682 mm in a diagonal plane defined by the tube axis and diagonal axis, the radius r of phosphor stripes remotest from the vertical axis Y—Y amounts to approximately 2,400 mm. In contrast, in a 19-inch color cathode-ray tube, in which the shadow mask 38 is formed such that its slit aperture interval increases along the horizontal axis X—X from its center to its periphery and that its section in a horizontal plane defined by the tube axis and horizontal axis is relatively flat, i.e., has a large radius of curvature and the face plate 36 is flattened and has a substantially rectangular front portion, the radius r of phosphor strips in regions remotest from the vertical axis Y—Y is approximately 5,000 mm, for instance. In this case, the phosphor stripes are more straight than in the prior art tube noted above. In this 19-inch color cathode-ray tube, the face plate inner surface has a radius of curvature of approximately 1,125 mm in the horizontal plane and a radius of curvature of approximately 1,200 mm in the diagonal, and the shadow mask has a radius of curvature of approximately 900 mm in the horizontal plane and a radius of curvature of approximately 1,090 mm in the diagonal plane. Also, the slit aperture interval of the shadow mask 38 increases along the horizontal axis X—X from the center of the shadow mask 38 to the periphery thereof. Further, the phosphor stripe interval of the groups of red, blue and green phosphor stripes in regions remotest from the vertical axis Y—Y, is set to 1.2 times the phosphor stripe interval in a central region of the phosphor screen. Indeed, in a color cathode-ray tube having a shadow mask 38 with the slit aperture interval thereof increased along the horizontal axis X—X from the center thereof to the periphery thereof, the phosphor stripes in the remotest regions from the vertical axis Y—Y are more strainght than in the conventional tube noted above. However, with this degree of straightness, the face plate itself will be rectangular and have square corners and straight edges. In this case, the appearance is again somewhat dissatisfactory.

Figure 1:
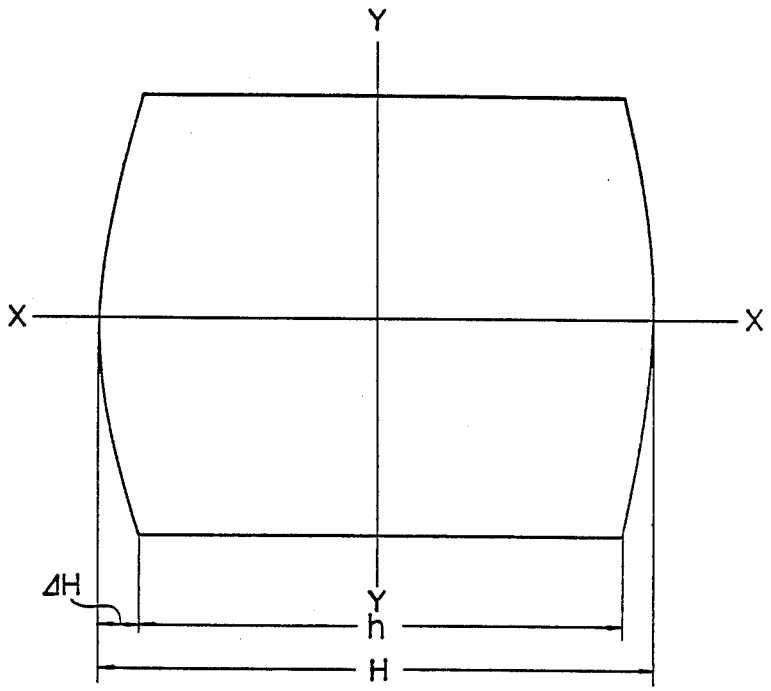
FIG. 1 is a schematic plane view showing the front shape of a conventional phosphor screen.
Figure 3:
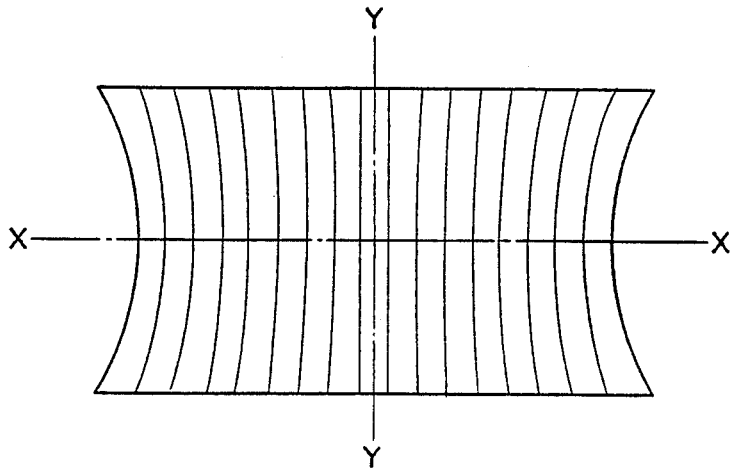
FIGS. 3 and 4 are schematic plane views showing pincushion type phosphor screens.

It is thought to form a rectangular phosphor screen, i.e., a phosphor screen with substantially straight phosphor stripes in remotest regions from the vertical axis, while eliminating the doming in the following way. In the conventional cathode-ray tube, the phosphor screen is barrel-shaped as shown in FIG. 1 Therefore, it is thought to form a phosphor screen such that the phosphor stripe interval is fixed on the horizontal axis X—X and that phosphor stripes are curved with different radiuses of curvatures which are decreased depending on the distance from the vertical axis along the horizontal axis X—X so that the phosphor strip interval in a region apart from the horizontal axis X—X is greater than that on the horizontal axis X—X, as shown in FIG. 3. However, such a phosphor screen will be distorted into a pincushion shape with its width smallest on the horizontal axis as is seen, the greater, the distortion the greater the number of phosphor stripes. Usually, a phosphor screen has 400 to 800 groups of red, green and blue phosphor stripes. It may be thought to form the phosphor screen such that the phosphor stripe interval of regions remotest from the horizontal axis X—X is greater substantially by 5% than that on the horizontal axis X—X. In this case, if the interval is 800 μm in a central region in the vertical axis Y—Y and 840 μm in peripheral regions, the difference ΔH between the width H of the phosphor screen on the horizontal axis H and the distance h between the corners thereof along the horizontal axis X—X is 16 to 32 mm. This phosphor screen will have a greater pincushion distortion.

Figure 4:
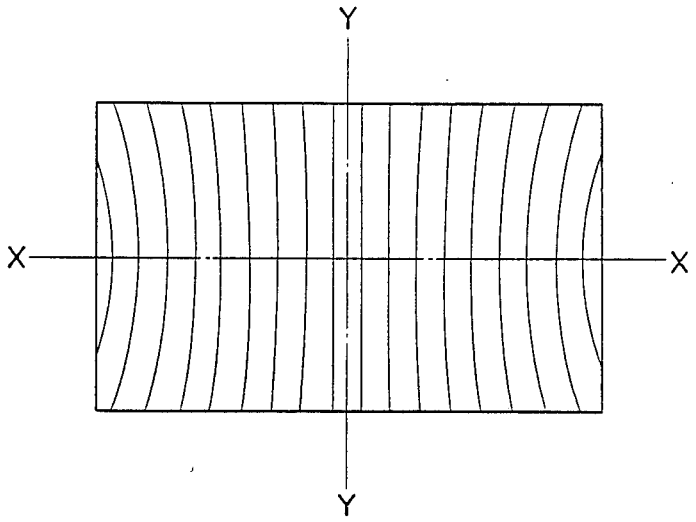

It is thought to obtain a rectangular phosphor screen by cutting the pincushion distortion type phosphor screen and removing the region apart from the vertical axis Y—Y as shown in FIG. 4. In this case, phosphor stripes are discontinuous on the opposite sides of the phosphor screen, so that the color purity is deteriorated in corner regions.

Figure 5:
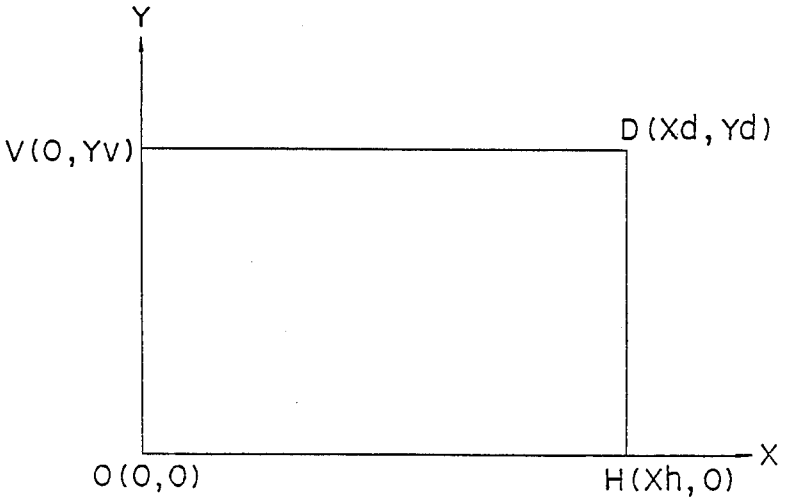
FIGS. 5 and 6 are graphical representations of the arrangement and intervals of apertures of the shadow mask along the horizontal axis X—X.
Figure 6:
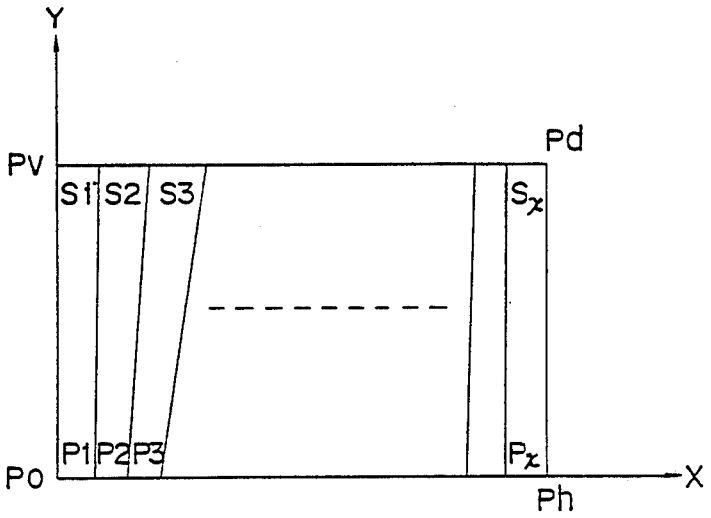

As a result of extensive investigations as described above, the inventor confirmed that the phosphor stripe interval of the phosphor screen should be varied smoothly or continuously in a permissible range as described in the following. FIG. 5 schematically shows the first quadrant portion of the shadow mask of the color cathode-ray tube shown in FIG. 2 in the coordinate system defined by the horizontal axis X—X and vertical axis Y—Y. In FIG. 5, the origin is taken for the center O of the shadow mask. The end of the shadow mask on the horizontal axis X—X is shown at H and having coordinates (Xh, O). Its end on the vertical axis Y—Y is shown at V and having coordinates (O, Yv). Its end on the diagonal axis is shown at D and having coordinates (Xd, Yd). In FIG. 6, denoting the slit aperture interval in the central region of this shadow mask by PO, the slit aperture interval in its end region on the horizontal axis X—X by Ph, the slit aperture interval of its end region on the vertical axis Y—Y by V, the slit aperture interval of its end region on the diagonal axis by Pd and one half of the number of the groups of red, blue and green phosphor stripes or the apertures of the shadow mask arranged along the horizontal axis X—X by n, the change in the slit aperture interval from PO to Ph by Px and the change in the slit aperture interval from PV to Pd by Sx, $\overline{OH}$ and $\overline{VD}$ are expressed as $$\overline{OH} = Xh = \sum_{x=1}^{n} Px \tag{1}$$

$$\overline{VD} = Xd = \sum_{x=1}^{n} Sx \tag{2}$$

It will be seen from the equations (1) and (2) that a phosphor screen may be shaped in a retangular shape by setting $\overline{OH} \leqq \overline{VD}$, i.e. $\overline{Xh} \leqq \overline{Xd}$.

A first increasing function Px representing the slit aperture interval change from PO to Ph and a second increasing function Sx representing a slit aperture interval change from PV to Pd, are given as $$Px = PO + A\left(\sum_{x=1}^{n} P_{x-1}\right)^{\alpha}$$

$$Sx = PV + B\left(\sum_{x=1}^{n} S_{x-1}\right)^{\beta}$$

Figure 7:
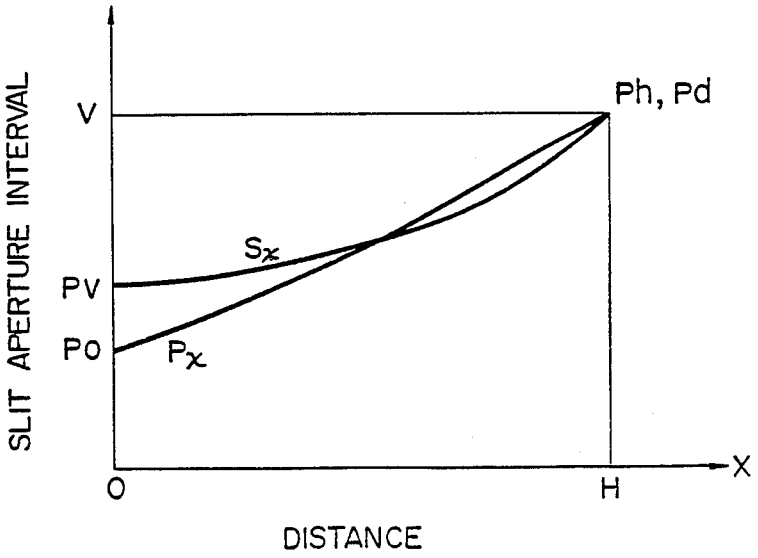
FIG. 7 is a graph showing the relation between the aperture intervals on the horizontal axis X—X of the shadow mask and aperture intervals in regions most remote from the horizontal axis X—X.

Here, PV > PO. It will be understood that if A and B are constants and $\beta > \alpha$, then $Xh \leqq Xd$ as shown in FIG. 7. For the color cathode ray tube of the subject invention, the following relationship can apply: PO < PV, PV < Pd.

Figure 8:
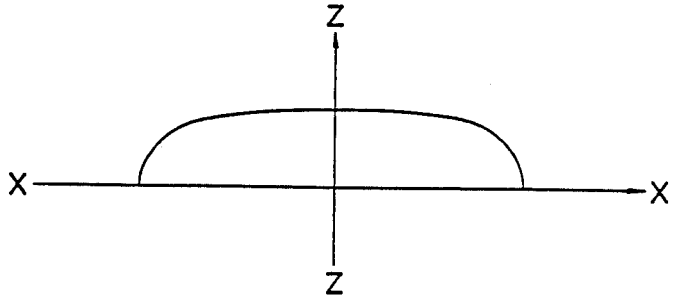
FIG. 8 is a schematic sectional view of a shadow mask for forming a rectangular phosphor screen.

The specific values of $\alpha$ and $\beta$ determined from the following standpoints. If $\alpha$ is greater than 3, the shadow mask will have a semi-oval horizontal sectional profile as shown in FIG. 8, so that its mechanical strength will be insufficient. Besides, the central region of the shadow mask will be flat, giving rise to doming to deteriorate the color purity. Further, the higher $\alpha$ is, the slit aperture interval will be increased the more sharply in peripheral regions of the shadow mask. In a phosphor screen formed for use with this shadow mask, the phosphor stripe interval will be increased in its peripheral regions on the horizontal axis, which is undesired from the standpoint of the sight as will. For the above reason, $\alpha$ is preferably smaller than 3 ($\alpha < 3$). On the other hand, $\beta$ has influence on the slit aperture interval and phosphor stripe interval of regions remote from the horizontal axis. That is, even if these intervals are increased, they will not give rise to so much sight problem as in the case of the phosphor stripe interval of the region on the horizontal axis. For the above reason, $\beta$ is preferably no greater than 6 ($\beta \leqq 6$).

A specific example of numerical values of the parameters in the embodiment of the 19-inch color cathode-ray tube described above is given below.

In case when the slit aperture interval PO of the central region is PO=0.60 mm, the slit aperture interval Ph of the end region on the horizontal axis X—X is Ph=0.72 mm, the slit aperture interval Pv of the end region on the vertical axis Y—Y is PV=0.65 mm and the slit aperture interval Pd of the end region on the diagonal line is Pd=0.72 mm, the slit aperture interval change Px from PO to Ph and that Sx from PV to Pd are $$Px = PO + A\left(\sum_{x=1}^{n} P_{x-1}\right)^{\alpha}$$

$$= 0.60 + 0.697 \times 10^{-3}\left(\sum_{x=1}^{n} P_{x-1}\right), \alpha = 1$$

$$Sx = PV + N\left(\sum_{x=1}^{n} S_{x-1}\right)^{\beta}$$

$$= 0.60 + 0.796 \times 10^{-10}\left(\sum_{x=1}^{n} S_{x-1}\right)^{4}, \beta = 4;$$

With a phosphor screen formed by the above shadow mask, the width H of the phosphor screen on the horizontal axis X—X is 370.8 mm, and the distance h between the corners thereof along the horizontal axis X—X is 370.0 mm. The difference ΔH between H and h is only 0.4 mm. In this case, the radius r of curvature of phosphor stripes in the remotest regions from the vertical axis Y—Y is approximately 17,000 mm, that is, phosphor stripes can be substantially straight.

As has been shown, a rectangular phosphor screen can be formed by appropriately determining the slit aperture interval and phosphor stripe interval which are related to the width of the phosphor screen and that of the shadow mask along the horizontal axis X—X. It is to be understood that the vertical dimension of the phosphor screen and shadow mask along the vertical axis, has nothing to do with the shape of the phosphor screen and can be freely set.

The shadow mask, in which the slit aperture interval that is related to the width of the shadow mask along the horizontal axis X—X, is formed with small radii of curvature in the horizontal plane, vertical plane and diagonal plane, i.e., curved as a whole more than the conventional shadow mask. It consequence, it is possible to sufficiently suppress doming that would otherwise occur during the initial state of operation of the color cathode-ray tube. For example, in the 19-inch color cathode-ray tube shown in Table 1, the radii of curvature in the vertical plane, horizontal plane and diagonal plane can be reduced by 18%, 13% and 11%, respectively.

TABLE 1

| Radii of curvature of face plate and shadow mask | | | |
|---|---|---|---|
| | Vertical plane | Horizontal plane | Diagonal plane |
| Face plate | 950 mm | 1,125 mm | 1,200 mm |
| Conventional shadow mask | 1,150 mm | 1,040 mm | 1,220 mm |
| Shadow mask According to the invention | 940 mm | 900 mm | 1,090 mm |

The conventional shadow mask in Table 1 was formed with the slit aperture interval set to a constant value of 0.75 mm.

Figure 9:
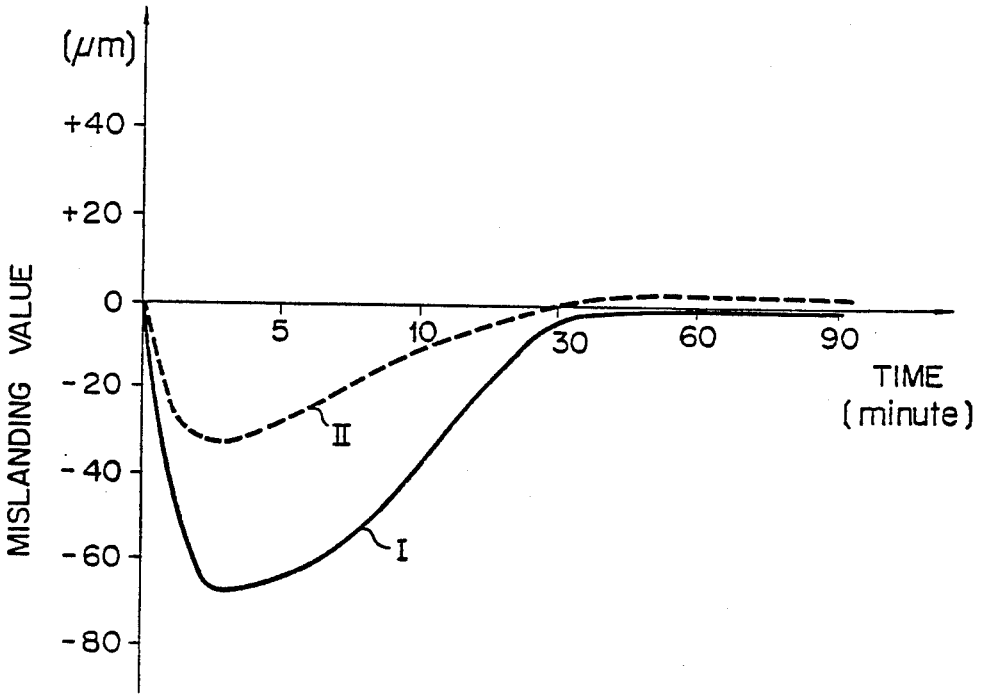
FIG. 9 is a graph showing the extent of mislanding of a conventional cathode-ray tube and a cathode-ray tube according to the invention from the start of operation of these tubes.

FIG. 9 shows the mislanding characteristics of the conventional color cathode-ray tube and color cathode-ray tube according to the invention from the start of operation thereof. In FIG. 9, the ordinate is taken for the extent of mislanding, and the abscissa for the time elapsed from the start of operation of the color cathode-ray tube. Curve I in FIG. 9 was obtained with conventional 19-inch 90-degree deflection type color cathode-ray tube fabricated by incorporating a conventional shadow mask in the face plate shown in Table 1. Curve II was obtained with a 19-inch 90-degree deflection type color cathode-ray tube according to the invention fabricated by assembling the shadow mask according to the invention in the face plate shown in Table 1. The mislanding to either of these color cathode-ray tubes was measured for a region at a distance of 125 mm from the center of the phosphor screen along the horizontal axis X—X and in an operation condition for white and black picture with high voltage 25 kv and beam current 1,500 μA. The mislanding toward the center of the phosphor screen is shown negative quantity, and that toward the periphery of the phosphor screen as positive quantity. As is obvious from the curves I and II shown in FIG. 9, with the color cathode-ray tube according to the invention the mislanding that occurs before the tube operation becomes stable is sufficiently reduced compared to the conventional color cathode-ray tube.

As has been described, with the color cathode ray tube according to the invention the phosphor screen can have a substantially rectangular shape providing for satisfactory appearance while sufficiently reducing the mislanding from the start of the operation to ensure satisfactory color purity at all time. According to the invention, the doming of the shadow mask can be decreased and the color purity can be improved in the color cathode ray tube with a greater screen size.

What is claimed is:

1. A color cathode-ray tube having a tube axis, a horizontal axis and a vertical axis, these being perpendicular to one another, comprising:

a face plate having an inner surface;

a phosphor screen formed on the inner surface of the face plate and including a plurality of groups of red, green and blue phosphor stripes, said phosphor stripes extending across the horizontal axis and being spaced apart therealong;

means for emitting electron beams toward the phosphor screen, said emitting means including electron guns arranged along the horizontal axis; and a shadow mask including a curved plate portion facing the inner surface of the face plate and having a plurality of slit apertures allowing passage of electron beams therethrough, the center-to-center interval Px between adjacent slit apertures along the horizontal axis being increased as a first function along the horizontal axis from the center of the shadow mask to the periphery thereof, the center-to-center interval Sx between adjacent slit apertures in peripheral regions remotest from the horizontal axis being increased as a second function different from the first function along the horizontal axis from the center of the shadow mask to the periphery of the shadow mask, the first and second functions being determined such that said phosphor screen has a substantially rectangular shape.

2. A color cathode-ray tube according to claim 1, wherein said first and second functions representing the respective slit aperture intervals Px and Sx are given as $$Px = PO + A\left(\sum_{x=1}^{n} P_{x-1}\right)^{\alpha}$$

$$Sx = PV + B\left(\sum_{x=1}^{n} S_{x-1}\right)^{\beta}$$

where X is 1, 2, 3, . . . , and $\alpha$ and $\beta$ are desired values.

3. A color cathode-ray tube according to claim 1, wherein the following relations are established;

$$PO < PV,\ OV < Pd$$

where PO is the slit aperture interval in a central region of the shadow mask, PV is the slit aperture interval on the vertical axis in the regions remotest from the horizontal axis, Ph is the slit aperture interval on the horizontal axis in the regions remotest from the vertical axis and Pd is the slit aperture interval in the corner regions remotest from the horizontal and vertical axes.

4. A color cathode-ray tube according to claim 3, wherein said first and second functions representing the respective slit aperture intervals Px and Sx are given as $$Px = PO + A\left(\sum_{x=1}^{n} P_{x-1}\right)^{\alpha}$$

$$Sx = PV + B\left(\sum_{x=1}^{n} S_{x-1}\right)^{\beta}$$

where X is 1, 2, 3, . . . , and $\alpha$ and $\beta$ are desired values.

5. A color cathode-ray tube according to claim 4, wherein said desired values satisfy relations $$\alpha < 3$$

and $$\beta \leqq 6.$$

6. A color cathode-ray tube according to claim 1, wherein the interval of the apertures of the shadow mask on the horizontal axis in the regions of the shadow mask remotest from the vertical axis along the horizontal axis is substantially equal to the interval of the apertures of the shadow mask along the horizontal axis in corner regions of the shadow mask remotest from the horizontal and vertical axes.

* * * * *